United States Patent [19]

Simo

[11] 4,074,674

[45] Feb. 21, 1978

[54] ARROW REST

[75] Inventor: Miroslav Andrew Simo, Riverside, Ill.

[73] Assignee: New Archery Products Corporation, Riverside, Ill.

[21] Appl. No.: 710,647

[22] Filed: Aug. 2, 1976

[51] Int. Cl.[2] ..... F41D 11/00

[52] U.S. Cl. ..... 124/41 A

[58] Field of Search ..... 124/41 A, 24 R, 86, 124/88, 89

[56] References Cited

U.S. PATENT DOCUMENTS

| | | | |
|---|---|---|---|
| 3,244,161 | 4/1966 | Jenson | 124/41 A X |
| 3,285,237 | 11/1966 | Wolfe | 124/41 A |
| 3,769,956 | 11/1973 | Simo | 124/41 A |
| 3,828,757 | 8/1974 | Finlay | 124/41 A |
| 3,871,352 | 3/1975 | Stanislawski et al. | 124/41 A |
| 3,896,782 | 7/1975 | Carella | 124/41 A |
| 3,935,854 | 2/1976 | Troncosco | 124/41 A X |

*Primary Examiner*—Richard C. Pinkham
*Assistant Examiner*—William R. Browne
*Attorney, Agent, or Firm*—Thomas W. Speckman

[57] ABSTRACT

An arrow rest for mounting on an archery bow to maintain an arrow shaft in desired position prior to release of arrow from bow. The arrow rest is spring biased in two planes, a generally horizontal plane and a generally vertical plane, or parallel to the bow. The arrow rest disclosed provides greater resistance to arrow shaft movement in the direction along the axis of the bow than resistance to movement in the horizontal plane. The arrow rest may be readily mounted in a predetermined position on the bow and provides for holding the arrow in desired position in side winds and when the bow is tilted from the vertical position.

19 Claims, 12 Drawing Figures

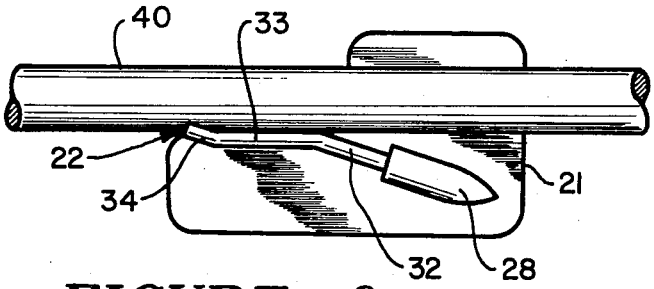
FIGURE 6
FIGURE 7
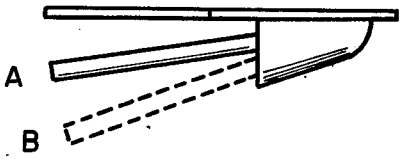
FIGURE 8
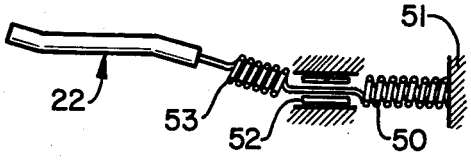
FIGURE 9
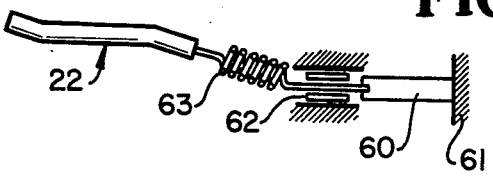
FIGURE 10
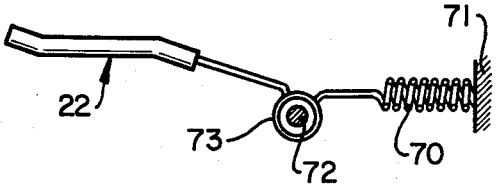
FIGURE 11
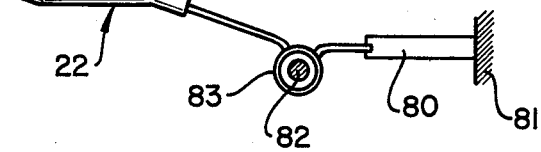

ARROW REST

This invention relates to an arrow rest for mounting on an archery bow to assist in the accuracy of shooting the arrows. The arrow rest of this invention is spring biased in two planes, one generally horizontal and the other generally vertical, or parallel to the bow, providing an appreciably stiffer spring action in the generally vertical plane than in the horizontal plane. The arrow rest of this invention maintains the arrow in position prior to release of the arrow from the bow and minimizes interference of the desired arrow path by the bow or the arrow rest and minimizes undesired forces which may be imparted by the bow string to the arrow upon release of the arrow.

One early type of arrow rest is the provision of a horizontal shelf on the bow itself for support and guiding of an arrow as it is shot from the bow. However, a rigid horizontal shelf has disadvantages including the deflection or damage of an arrow by engagement of the rigid shelf with the fletching on the arrow causing the arrow to deviate from its path and causing damage to the fletching. There have been several methods of attempting to improve the fixed horizontal shelf arrow rest by the provision of flexible material on top of the shelf such as fur or brushes for support of the arrow while decreasing undesired deflection. However, these methods have not proved satisfactory since they may become worn through use and the level of support of the arrow changes. Further, bows having horizontal shelves tend to crack in the vicinity of the shelves which has led to curved shelves. The curved shelves have rendered difficult if not impossible, the use of many of the prior mechanical type arrow rests.

A wide variety of mechanical devices have been developed in attempts to overcome many of the above disadvantages of the horizontal shelf, but these too have inherent disadvantages in their various designs. Many of the mechanical devices are located above the horizontal shelf of the bow and thereby raise the point along the bow at which the arrow rests. It must be recognized that a bow is designed to provide balanced forces on the arrow through the bow string when the drawn arrow rests at a predetermined point on the bow. When the arrow rests at a significantly different location, the forces applied by the bow string will not be balanced and the arrow flight is not true.

A wide variety of mechanical arrow rests have been devised to attempt to overcome deflection of the arrow as it leaves the bow. Exemplary of such mechanical devices are those disclosed in U.S. Pat. Nos. 3,232,286, 3,482,563 and 3,757,764, utilizing a plunger assembly for engaging the shaft of an arrow; various spring biased straight arm type arrow rests which are spring biased only in the horizontal plane as exemplified by U.S. Pat. Nos. 3,769,976, 3,828,757, 2,980,097; and arrow rests which permit independent adjustment of both the vertical and lateral positioning relative to the bow as exemplified by U.S. Pat. No. 3,871,352.

It is an object of this invention to overcome disadvantages of arrow rests of the prior art.

It is a further object of this invention to provide an arrow rest which furnishes spring actuated flexibility in two planes when the arrow shaft if positioned thereon.

It is yet another object of this invention to provide an arrow rest which may be readily mounted in a predetermined desired position on a bow so as to conform to the design characteristics of the bow.

It is yet another object of this invention to provide an arrow rest in which the resistance to arrow shaft movement in the direction along the axis of the bow is greater than resistance provided in the plane at right angles thereto.

It is still another object of this invention to provide an arrow rest having an arrow support means for holding the arrow in desired position in side winds and when the bow is tilted from the vertical position.

These and other objects and advantages of this invention will become apparent from the following description and the drawings showing preferred embodiments wherein:

FIG. 6 is a side view showing an arrow rest of another embodiment of this invention showing an arrow shaft resting upon the arrow support means;

FIG. 7 is a top view of the arrow rest shown in FIG. 6;

FIG. 8 is a partial section schematic view showing utilization of two spiral springs for providing bias in two planes in an arrow rest according to this invention;

FIG. 9 is a partial section schematic view showing utilization of a leaf spring for bias in one plane and a spiral spring for bias in a second plane in an arrow rest according to this invention;

Figure 1:
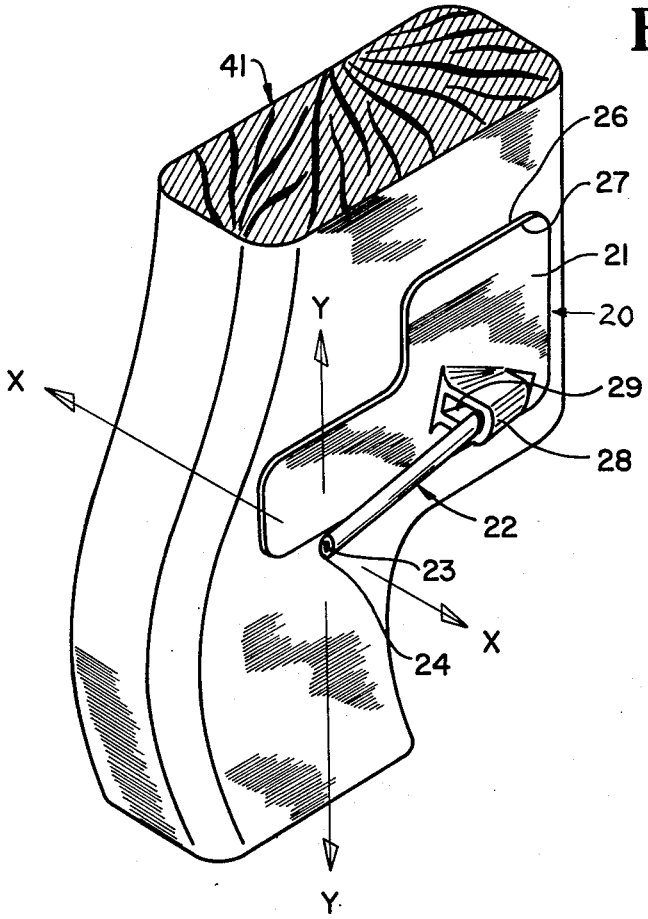
FIG. 1 is a perspective view of one embodiment of an arrow rest according to this invention.

FIG. 10 is a partial section schematic view showing utilization of a spiral spring to provide bias in one plane and a coil spring for bias in a second plane in an arrow rest according to this invention; and FIG. 11 is a partial section schematic view showing utilization of a leaf spring to provide bias in one plane and a coil spring for bias in a second plane in an arrow rest according to this invention.

This invention provides an arrow rest for attachment to an archery bow providing spring biased movement in two planes which comprises mounting means to secure the arrow rest in desired position on the bows, spring means having a first end in fixed relation to the mounting means and the other second end moveable in a first plane generally parallel to the plane of the bow and in a second plane generally at right angles to the first plane, arrow support means having a first end in fixed relation to the second end of the spring means and the other second end adapted to support an arrow shaft and spring housing means affixed to the mounting means for securement of the first end of the spring means and for providing movement restriction to the spring means. By the terminology "generally parallel" and "generally at right angles" I mean that the angles can vary up to about plus and minus 10 degrees. In a preferred embodiment the arrow support means is provided with an arrow holding portion which retains the arrow shaft in a position during side winds and when the bow is oblique to the vertical as frequently occurs during hunting. One embodiment of this invention provides an arrow rest utilizing one spring to provide movement of the arrow support means in two planes with significantly greater resistance to movement in one plane than in a second plane at approximately right angles.

Referring to the embodiment of the arrow rest according to this invention shown in FIGS. 1 through 5, FIG. 1 shows the arrow rest generally referred to as 20 mounted on the side of bow 41. Arrow rest 20 has mounting means 21 for attachment to bow 41 and moveable arrow support means 22 attached in moveable relation to bow 41 through housing 28. Arrow support means 22 is moveable in generally horizontal plane X—X and in generally vertical plane shown as Y—Y. Arrow support means 22 holds the arrow toward its outer extremity and is adjustably biased in both the horizontal and vertical planes by the operation of spring means 31 within housing means 28.

Mounting means 21 is preferably a thin flexible material in the form of a plate which may conform to the surface of bow 41 at the desired location of mounting regardless of whether the bow is flat or has simple or complex curvatures at that point. Further, the thinness of the plate of mounting means 21 is important so that the arrow is directly in front of the bow string when resting upon the arrow rest and allows for greater left or right adjustment of the arrow relative to the center of the bow, known as "center shot" adjustment.

Mounting means 21 has mounting plate rear surface 26 on the side toward the bow and mounting plate front surface 27 on the side away from the bow. Mounting plate rear surface 26 may have attached to it or may be coated with any adhesive suitable for firm attachment to the bow. Particularly suitable are pressure sensitive adhesives well known in the art. The adhesive may be applied to mounting plate rear surface 26 and covered with a sheet of protective paper (not shown) which may be removed just prior to mounting the arrow rest on a bow. There are numerous pressure sensitive materials readily available and use of a woven fabric having a pressure sensitive adhesive on each side is particularly suitable since the fabric may be assembled to mounting plate rear surface 26 during manufacture and further provide additional cushioning and form fitting to mounting means 21 for attachment to the bow.

Figure 2:
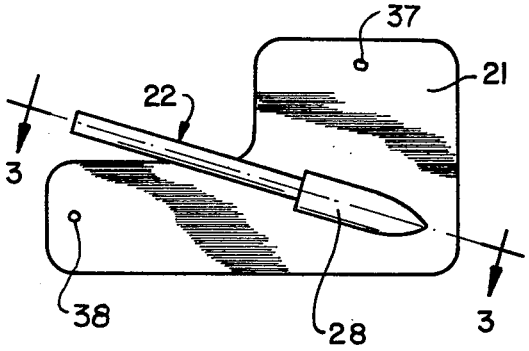
FIG. 2 is a side view of the arrow rest shown in FIG. 1.

Mounting means plate 21 may have holes 37 and 38 therethrough, as shown in FIG. 2, to assure mounting of the arrow rest in the desired position on the bow. The desired position of the arrow rest on the bow can be determined and holes can be drilled in the bow through holes 37 and 38. Guide pegs, which fit snugly into holes 37 and 38, can be fastened in the holes in the bow and extend beyond the surface of the bow for a distance about the thickness of mounting means plate 21, or less. This permits an arrow rest to be remounted or a new arrow rest to be mounted in exactly the same desired position by the guide pegs extending into holes 37 and 38.

The shape of mounting means 21 is not critical to this invention, but it should be of sufficient size to provide secure fastening of the arrow rest to the bow. Instead of the adhesive fastening, any other suitable fastening means may be used such as screw fastenings, clamp fastenings, binding fastening, and the like. Importance of the fastening means is firm retention of the arrow rest in constant desired relationship with the bow.

Adjacent to mounting plate front surface 27 is housing means 28. Housing means 28 may be of any suitable shape for carrying the desired spring means and permitting desired movement of arrow support means 22. Housing 28 may be molded in one piece with mounting plate 21, particularly if these portions are plastic, or may be separate and suitably attached to mounting plate 21 if these components are metal.

In the embodiment shown in FIGS. 1 through 5, housing 28 has slot 29 to permit horizontal movement of arrow support means 22 and horizontal flexing of spring 31. Spring well 30 secures one end of spiral spring 31 in fixed relation to mounting means 21. The other second end of spring 31 away from housing well 30 carries arrow support means 22.

Arrow support means 22 comprises arrow support wire 23 which has spring carrying first end 32 affixed to spring 31 and arrow carrying end 33 at the other second end. To further reduce friction in the portion of the arrow support means upon which the arrow rests, arrow support wire 23 may be covered by arrow support wire sleeve 24 which acts as a friction reducing cover to reduce the frictional drag of the arrow across the arrow support means. Sleeve 24 is preferably made of a friction reducing plastic such as fluorinated hydrocarbons (Teflon) or the arrow support wire 23 may be coated with a friction reducing material. Any friction reducing material known to the art is suitable.

The embodiment of this invention shown in FIGS. 1 through 5 utilizes one spiral spring to provide spring bias movement of the arrow carrying end of the arrow support means in two planes. Reference throughout this disclosure will be made to movement in a generally vertical plane shown as Y—Y in FIG. 1 and it will be recognized that such movement may not be truly vertical since the bow may be held at oblique angles to as much as 45° from vertical. However, movement in plane Y—Y will be in a plane generally parallel to the plane of the bow, but it must also be recognized that there may be up to about 20° variation in these planes. Likewise, movement of arrow support means will be referred to in the application as in a generally horizontal plane meaning the X—X plane as shown in FIG. 1 which is generally at right angles to the vertical plane but again, may vary as much as about 20°. It is desired that movement in the vertical plane be significantly more restricted and highly biased than movement in the horizontal plane. In practice, it is desired that the resistance of the arrow support means to movement in the vertical plane be about 10 to 30 times the resistance to movement in the horizontal plane. Preferably, movement of the arrow holding end of the arrow support means in the horizontal plane will offer a resistance of about 0.1 to 1 ounce in movement away from the bow and minimal resistance in movement toward the bow. Resistance of the arrow carrying end of the arrow support means to downward movement in the vertical plane will be about 2 to 30 ounces.

Figure 3A:
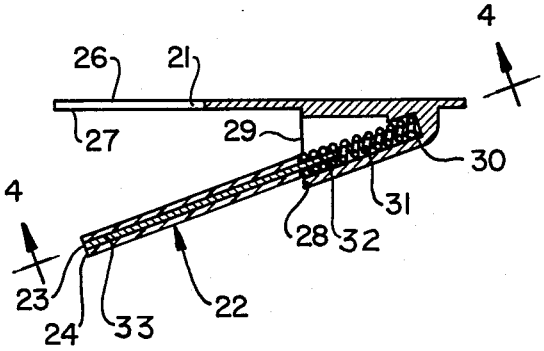
FIG. 3A is a sectional view along the line shown as 3—3 in FIG. 2 showing the spring means in an unflexed position.
Figure 3B:
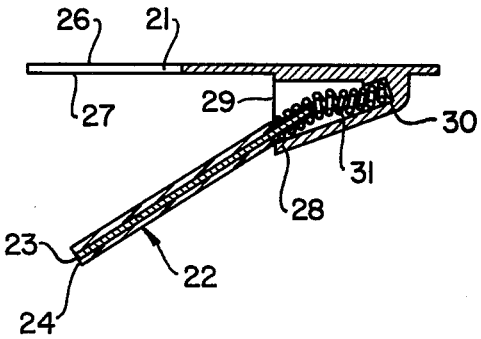
FIG. 3B is the same sectional view as shown in FIG. 3A except the spring means is shown in a flexed position.
Figure 4:
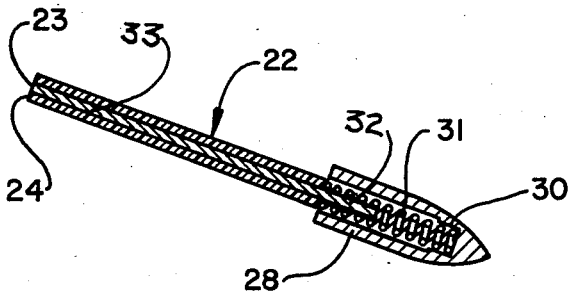
FIG. 4 is a sectional view of the arrow support means and housing along line 4—4 in FIG. 3A.
Figure 5:
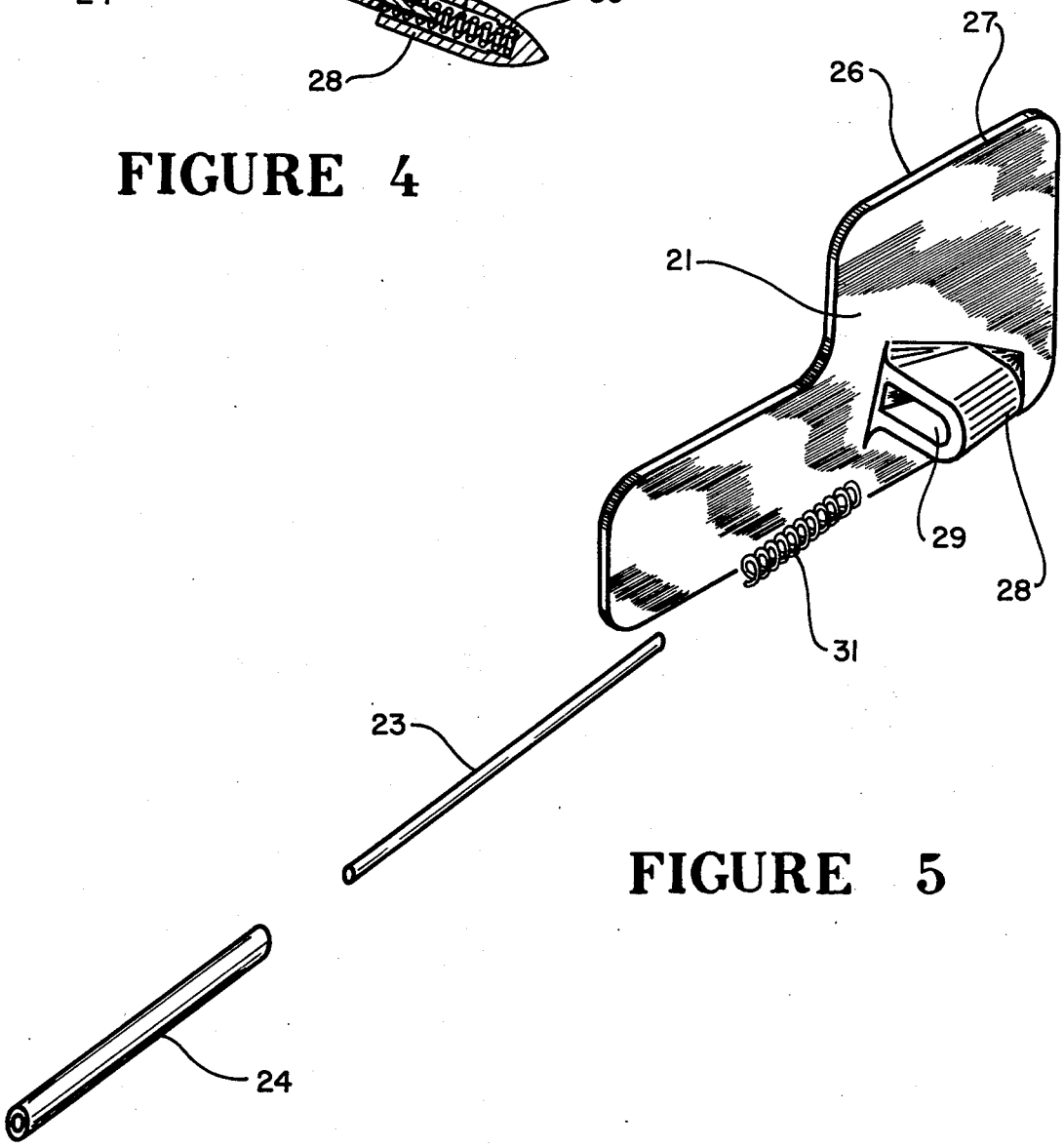
FIG. 5 is an exploded perspective view of the arrow rest shown in FIGS. 1–4.

Provision for movement of arrow support means 22 is best seen in FIGS. 3 and 4 wherein it is seen that spring carrying end 32 of arrow support wire 23 is fixed within spiral spring 31, but does not extend to housing well 30. As shown in FIG. 4, space provided between housing means 28 and spiral spring 31 allows movement of arrow carrying end 33 of arrow support wire 23 in the generally vertical direction restricted by the length of housing 28 along spring 31 beyond well 30. To obtain greater vertical movement, spring 31 may extend further beyond the open end housing means 28. Resistance to vertical movement may also be adjusted by the distance spring carrying end 32 of arrow support wire 23 extends within spring 31 and the open distance between that end of arrow support wire 23 and the position in which spring 31 is held within well 30 in a fixed fashion. It is desired that during the time of drawing the bowstring and aiming the arrow the arrow shaft be held at the designed vertical location along the bow so that the forces applied to the arrow shaft upon release will be as desired by the design of the bow. Upon release of the bowstring, there is usually a downward force on the arrow. It is desired that this be absorbed by the vertical bias of the spring so that the arrow shaft remains in contact with the arrow support means and is returned to the desired vertical positon after absorption of such initial forces. One disadvantage with arrow rests which are fixed in the vertical direction has been that the arrow shaft tends to bounce off the rest, causing the arrow to deviate from its desired path.

Horizontal movement of arrow carrying end 33 of arrow support wire 23 may best be seen in FIGS. 3A and 3B in conjunction with FIG. 7. The width of housing slot 29 limits the horizontal movement of arrow carrying end 33 of arrow support wire 23. As seen in FIG. 3B, the open distance between the end of spring carrying end 32 of arrow support wire 23 and housing well 30 determines the resistance to and the limit of movement of arrow support wire 23 away from the bow as the arrow is drawn backwards over the arrow support while drawing the bowstring into shooting position. It is desired that during the time of drawing the bowstring and aiming the arrow shaft be held against the side of the bow by arrow support wire 23. When the arrow is in the drawn position, the arrow carrying end 33 of arrow support wire 23 is extended away from the bow as shown in FIG. 3B. When the bowstring is released, the forward movement of the arrow shaft causes arrow carrying end 33 of arrow support wire 23 to pivot toward the bow shown as A in FIG. 7 so the arrow support means 22 will not be engaged by the fletching. If the fletching does engage arrow carrying end 33, the interference will be minimal since arrow support means 22 is free to move with minimal resistance toward the bow in slot 29 of housing 28. After the arrow has left the bow, arrow support means 22 is returned to the position shown in FIG. 3A by action of spring 31.

It is preferred that arrow carrying end 33 of arrow support wire 23 have at its extremity arrow holding portion 34 which may be bent or contoured to cradle arrow shaft 40 as shown in FIG. 6. When the arrow rest of this invention has arrow holding portion 34, the arrow shaft is held in desired position when the bow is tilted as far as 45° away from vertical. One disadvantage of prior arrow rests has been that the arrow shaft tends to fall off the support arm or shelf if the bow is held obliquely as occurs especially during hunting.

It must be appreciated that according to this invention arrow support wire 23 may provide a minor amount of flexibility in itself, but that the principal spring action is provided by spring means affixed to spring carrying end 32 of arrow support wire 23. Any suitable single spring or combination of multiple springs providing desired bias in the desired planes may be utilized in this invention. The invention has been described above using a single spiral spring as a preferred embodiment. Other preferred embodiments are schematically shown in FIGS. 8–11. In FIGS. 8–11, the arrow support means 22 is maintained in the same position relative to the bow and moves in the same fashion as explained with respect to FIGS. 1–7.

FIG. 8 illustrates spring means using spiral spring 40 for generally horizontal bias and spiral spring 53 for generally vertical bias. Spring 50 is maintained at a first end in fixed relation to mounting means 51 by any suitable means, equivalent to housing well 30 as explained above. Slot 52 schematically is equivalent to housing slot 29 as described above limiting vertical movement while permitting free horizontal movement by stops at the ends of end slot 52. Spring 53 provides resistance to vertical Spring 53 provides resistance to vertical movement of arrow support means 22 by virtue of having a first end restricted to vertical movement by slot 52 and the second end in fixed relation to arrow support means 22.

The embodiment shown in FIG. 9 functions in the same manner as that described above with respect to FIG. 8 except that leaf spring 60 is substituted for spiral spring 50. Leaf spring 60 may be designed to provide minimal resistance to horizontal movement of arrow support arm 22 being sufficient to return arrow support arm 22 to its desired position after the arrow has left the bow.

FIG. 10 schematically illustrates still another embodiment of this invention wherein bias to horizontal movement is provided by spiral spring 70 and resistance to vertical movement is provided by coil spring 73. In this embodiment, rather than providing limits to horizontal movement by slot 52 as described with respect to FIG. 8, coil spring 73 moves along shaft 72 between stops providing restriction at the desired extremes of horizontal movement. It is apparent that a configuration utilizing a slot such as slot 52 may be readily adapted to the embodiment shown in FIG. 10 by placing the slot between springs 70 and 73.

FIG. 11 shows another embodiment of spring means which may be utilized in this invention which is similar in function to that explained in FIG. 10 except that leaf spring 80 is substituted for spiral spring 70.

It must be appreciated that in the description of FIGS. 8–11, the means for restriction of both horizontal and vertical movement as well as the securement of the spring means at the end opposite arrow support means 22 comes within the terminology referred to above as spring housing means, that is, spring housing means is affixed to the mounting means, secures the first end of the spring means and provides movement restriction to the spring means.

The arrow rest of this invention may be constructed out of any suitable materials providing durability and weather-resistance. It is particularly preferred to mold the mounting means and housing means in one piece from moldable plastics well known in the art. The spring means and arrow support wire are preferably fabricated from stainless steel or other corrosion resistant material.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrow rest for attachment to an archery bow comprising:

mounting means to secure said arrow rest in desired position on a first side of a bow adjacent the shaft of an arrow when in position to be shot from a bow;

spring means extending outwardly from said first side of a bow when said arrow rest is attached to a bow, said spring means having a first end in fixed relation to said mounting means and the opposite second end movable means and the opposite second end movable in a first plane generally parallel to the plane of a bow and in a second plane generally at right angles to said first plane;

arrow support means having a first end in fixed relation to said second end of said spring means an an opposite second end adapted to provide the complete support to an arrow shaft, freely resting on the top thereof, in the vicinity of a bow; and spring housing means immovably affixed to said mounting means for securement of said first end of said spring means and for providing movement restriction to said spring means.

2. The arrow rest of claim 1 wherein said second end of said arrow support means has a friction reducing surface.

3. The arrow rest of claim 1 wherein said second end of said arrow support means is curved in contour to cradle an arrow shaft.

4. The arrow rest of claim 1 wherein said mounting means is provided with an adhesive on its rear surface adjacent said bow.

5. The arrow rest of claim 4 wherein said adhesive is a pressure sensitive adhesive.

6. The arrow rest of claim 1 wherein said spring means comprises two spiral springs, one for bias in one plane and the other for bias in a second plane.

7. The arrow rest of claim 1 wherein said spring means comprises a leaf spring for bias in one plane and a spiral spring for bias in a second plane.

8. The arrow rest of claim 1 wherein said spring means comprises a spiral spring for bias in one plane and a coil spring for bias in a second plane.

9. The arrow rest of claim 1 wherein said spring means comprises a leaf spring for bias in one plane and a coil spring for bias in a second plane.

10. The arrow rest of claim 1 wherein said spring means provides a bias in said first plane about 10 to 30 times the bias in said second plane.

11. The arrow rest of claim 1 wherein said arrow support means extends outwardly and upwardly from said first side of the bow when said arrow rest is attached to the bow.

12. An arrow rest for attachment to an archery bow comprising:

mounting means to secure said arrow rest in desired position on a first a of said bow adjacent the shaft of an arrow when in position to be shot from a bow;

a single spiral spring means extending outwardly from said first side of the bow when said arrow rest is attached to the bow, said spring means having a first end in fixed relation to said mounting means and the opposite second end moveable in a first plane generally parallel to the plane of a bow and in a second plane generally at right angles to said first plane;

arrow support means for freely supporting an arrow, said arrow support means comprising a wire having a first end extending in fixed relationship within said second end of said spiral spring means and providing space within said spiral spring means between the first end of said arrow support wire and the securement of the first end of said spring means, the opposite second end of the arrow support wire adapted to provide the complete support to an arrow shaft in the vicinity of an bow; and spring housing means affixed to said mounting means for securement of said first end of said spring means and for providing movement restriction to said spring means.

13. The arrow rest of claim 12 wherein the securement of said first end of said spiral spring comprises a well in said spring housing means.

14. The arrow rest of claim 12 wherein said second end of said arrow support wire has a friction reducing surface.

15. The arrow rest of claim 12 wherein said second end of said arrow support wire is curved in contour to cradle an arrow shaft.

16. The arrow rest of claim 12 wherein said said mounting means in provided with an adhesive on its rear surface adjacent a bow.

17. The arrow rest of claim 16 wherein said adhesive is a pressure sensitive adhesive.

18. The arrow rest of claim 12 wherein said spring provides a bias in said first plane about 10 to 30 times the bias in said second plane.

19. The arrow rest of claim 12 wherein said arrow support wire extends outwardly and upwardly from said first side of a bow when said arrow rest is attached to a bow.

* * * * *